US005785109A

United States Patent [19]

Hongawa

[11] Patent Number: 5,785,109

[45] Date of Patent: Jul. 28, 1998

[54] METHOD FOR CASTING WEAR RESISTANT PARTS

[75] Inventor: Hiroyuki Hongawa, Himi, Japan

[73] Assignee: Komatsu Ltd., Tokyo, Japan

[21] Appl. No.: 737,477

[22] PCT Filed: May 10, 1995

[86] PCT No.: PCT/JP95/00895

§ 371 Date: Feb. 4, 1997

§ 102(e) Date: Feb. 4, 1997

[87] PCT Pub. No.: WO95/31304

PCT Pub. Date: Nov. 23, 1995

[30] Foreign Application Priority Data

May 13, 1994 [JP] Japan ..... 6-123337

[51] Int. Cl.[6] ..... B22D 19/14; B22D 27/00

[52] U.S. Cl. ..... 164/59.1; 164/112; 164/97

[58] Field of Search ..... 164/112, 97, 57.1, 164/58.1, 59.1

[56] References Cited

U.S. PATENT DOCUMENTS

| | | | |
|---|---|---|---|
| 887,648 | 5/1908 | Kemery | 164/57.1 |
| 1,374,509 | 4/1921 | Lomax | 164/57.1 |

FOREIGN PATENT DOCUMENTS

| | | | |
|---|---|---|---|
| 60-196259 | 10/1985 | Japan | 164/58.1 |
| 60-221166 | 11/1985 | Japan . | |
| 60-261657 | 12/1985 | Japan . | |
| 2-187250 | 7/1990 | Japan . | |
| 3-28974 | 4/1991 | Japan . | |
| 7-214288 | 8/1995 | Japan . | |
| 1519837 | 11/1989 | U.S.S.R. | 164/57.1 |

*Primary Examiner*—Kuang Y. Lin
*Attorney, Agent, or Firm*—Sidley & Austin

[57] ABSTRACT

A method for casting wear resistant parts which is capable of forming a hardened portion at a desired position with ease, whereby a wear resistant part can be obtained which has both wear resistance and toughness. To this end, the method includes the steps of filling the cacity of a holding member (16), which can be melted into molten steel, with a hardened portion forming material (19) comprising superhard particles (17), placing the holding member (16) which has been so filled with the hardened portion forming material (19) in a casting mold (10), pouring molten steel into the casting mold (10), thereby causing not only the holding member (16) to be melted into molten steel but also the superhard particles (17) to be dispersed, and solidifying the molten steel. In addition, the hardened portion forming material (19) can be constituted by superhard particles (17) and graphite powder (18) and/or metallic powder.

19 Claims, 4 Drawing Sheets

METHOD FOR CASTING WEAR RESISTANT PARTS

TECHNICAL FIELD

The present invention relates to a method for casting wear resistant parts, and particularly to a preferred method for casting wear resistant parts requiring a high degree of hardness.

BACKGROUND ART

Conventionally, as a method for casting parts which aims at increasing the longevity of the parts by increasing the hardness of the portions required to have wear resistance, there is the following art.

After casting a part in a specified form by using low-carbon steel, cementation is applied to increase the amount of carbon on the surface of the part, and the hardness on the surface is increased by quenching, etc. If necessary, tempering is conducted to make a wear resistant part having both wear resistance and toughness. It is known that a wear resistant part can be made by casting by using medium carbon steel and then, after casting, by conducting high-frequency induction hardening, which can be performed in a short time.

With the cementing method, the surface can be highly hardened with a hardness Hv as high as 850; however, when a greater hardened depth is required, for example, when a depth of some 2 mm or more is needed, the treatment takes an extremely long time, so that there is a disadvantage of the parts being expensive. In addition, in a high-frequency induction hardening method, it is necessary to produce a quenching coil for each cast part in every kind of form, and it is difficult to obtain a constant hardness and hardened depth except in the case of cast parts of a simple form.

As another conventional art, an insert-casting method includes the steps of setting superhard chips on a surface in a casting mold and of pouring molten steel, the above-described chips are bonded and an extremely hard wear resistant part is obtained (refer to, for example, Japanese Patent Application Laid-open No. 2-187250). Wear resistance is obtained by setting a fine thread of high-alloy steel in the form of a net at a fixed seat provided in the casting mold, coating this fine thread with superhard alloy particles if necessary, and by pouring molten steel (refer to, for example, Japanese Patent Application Publication No. 3-28974).

However, with this superhard chip insert-casting method, when an insert-casting portion with relatively low hardness is worn so that the superhard chips are in a state of being exposed, etc., the superhard chips with low toughness are damaged and broken by impactive load, etc.; therefore there is a disadvantage of a short life of a part, even though superhard chips with extremely high hardness are provided. In the method using a fine thread of high-alloy steel, breakage and damage are rarely caused, but the method of holding superhard alloy particles in a specified portion is difficult, and there is a disadvantage of a large number of man-hours required.

Further, in Japanese Patent Application No. Laid-open-714288 the applicant for the present invention proposed that wear resistant parts with high hardness can be obtained by coating the surface of a casting mold with graphite powder, etc., then pouring molten steel into the coated mold to form a high carbonate hardened layer on the surface of the part, and by applying heat treatment if necessary.

However, such a coating method, whereby the hardened depth is about 3 mm, has a disadvantage of being unable to form a thicker hardened layer.

BRIEF SUMMARY OF THE INVENTION

The present invention is made in order to eliminate the above-described disadvantages of the conventional art, and its object is to provide a method for casting wear resistant parts which is capable of forming a hardened portion at a desired position with ease, and which is preferred for producing cast parts having both wear resistance and toughness.

The method for casting wear resistant parts relating to the present invention is a method for casting wear resistant parts including a superhard portion, and is characterized by including the steps of filling the cavity of a holding member, which can be melted by molten steel, with a hardened portion forming material constituted by superhard particles, placing in a casting mold the holding member which has been filled with the hardened portion forming material, pouring molten steel into the casting mold, thereby causing the holding member to be melted into the molten steel with the superhard particles being dispersed, and solidifying the molten steel. The hardened portion forming material can be constituted by superhard particles, with graphite powder and/or metallic particles. Further, the holding member can be formed of a hollow pipe made of mild steel which can be melted by the molten steel.

By this constitution, the holding member with superhard particles filled therein is melted by the molten steel, so that the superhard particles contact the molten steel and disperse into the molten steel. Then a cast part, obtained after solidification by cooling, has superhard particles dispersed on the surface and/or inside. Accordingly, the portion where the superhard particles are dispersed, forms a hardened portion with high hardness, while the portions other than the hardened portion have the characteristics of the components of molten steel, so that wear resistant parts having not only high hardness portions but also toughness can be manufactured.

When graphite powder is added to superhard particles, the graphite powder diffuses as it is melted into the molten steel when molten steel is poured, so that the portion in which the graphite powder diffuses becomes high-carbonate and has high hardness. By adding metallic particles such as various kinds of alloy particles, etc., the material can be partially adjusted since the metallic particles disperse as they are melted into the molten steel.

Further, by using a mild steel pipe as the holding member, the holding member can be easily placed in a desired position in the casting mold, and the size, form, etc., of the holding member, that is, the size, form, etc., of a state in which superhard particles are filled, can be selected according to the requirements, so that the position of a hardened portion and the volume of a hardened portion can be controlled at will.

BRIEF DESCRIPTION OF THE DRAWINGS

FIGS. 10A and 10B are diagrams explaining an end bit relating to the fourth embodiment of the present invention, wherein FIG. 10A is a transverse cross-sectional view of an essential part of a casting mold for an end bit, while FIG. 10B is a schematic sectional view after casting;

BEST MODE FOR CARRYING OUT THE INVENTION

A preferred embodiment of a method for casting wear resistant parts relating to the present invention will be particularly described below with reference to the attached drawings.

Figure 1:
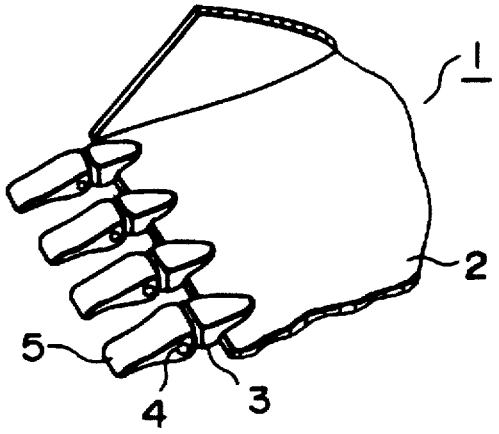
FIG. 1 is a perspective view of the main part of a bucket for an excavating machine, which is an example for applications relating to the first and second embodiments of the present invention.

The first embodiment is the case in which the present invention is applied to a tooth, which is a type of cutting part for an excavating machine. In FIG. 1, a bucket 1, provided at the end of a working machine (not illustrated in the drawings) of a construction machinery such as, for example, a hydraulic shovel which is one of the types of excavating machines, includes a plurality of attaching members 3 at the end portion of a bucket body 2, and a plurality of teeth 5, forming cutting parts, are respectively attached to the attaching members 3 by pins 4.

Figure 2:
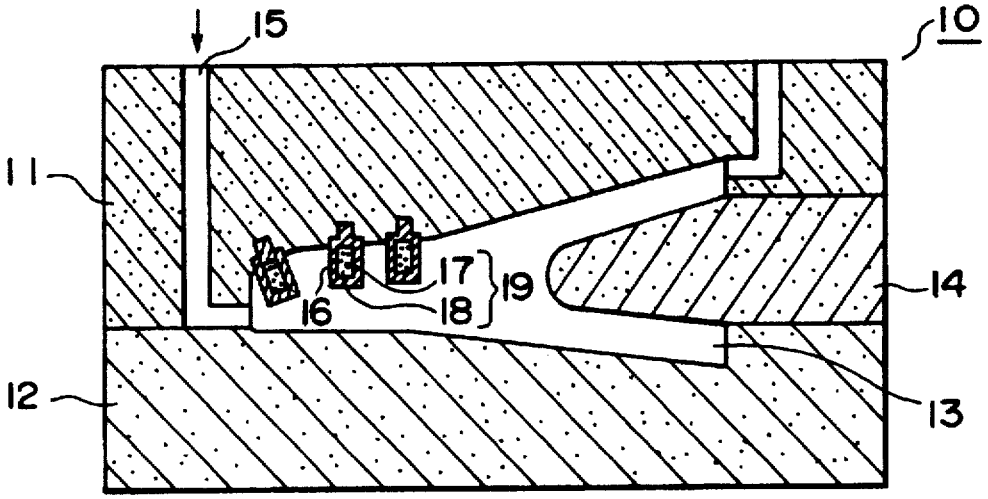
FIG. 2 is an explanatory view of a section of the casting mold relating to the first embodiment.

In FIG. 2, a casting mold 10 is defined by casting mold sections 11 and 12, and forms a cavity 13 for a tooth 5 (refer to FIG. 1). The casting mold section 11 includes a pouring gate 15, as well as a core 14 for the concave portion of the tooth 5. Molds for ordinary casting, such as a green sand mold, a $CO_2$ mold, a self-strengthening mold, etc., are used for these casting mold sections 11 and 12. The casting mold section 11 also includes a plurality of holding members 16, with one part of each holding member 16 projecting into the cavity 13 and one part of the holding member 16 being buried in the casting mold section 11. In this way, the holding members 16 can be placed at specified positions with ease and stability. Though a mild steel pipe is used for each of these holding members 16, various kinds of metal such as steel, copper, nickel, etc., composite material, non-metal materials such as resin, etc., can be used as long as it can be melted into molten steel.

The cavity of each above-described holding member 16 is filled with a hardened portion forming material 19. In the present embodiment, both ends of the mild steel pipe are sealed after the mild steel pipe has been filled with the hardened portion forming material 19. This hardened portion forming material 19 can be constituted by some 60% by weight of superhard particles 17 and some 40% by weight of graphite powder 18, and tungsten cemented carbide (for example, $W_2C$) superhard alloy particles can be used as the superhard particles 17. The superhard alloy particles in the present embodiment are mixed-size particles with most particle diameters in the range of 0.1 to 0.7 mm.

With use of the casting mold 10 of the above-described constitution, molten steel for steel casting is poured into the pouring gate 15. Typically, this molten steel can be composed of low-carbon steel with the amount of carbon being in the range of 0.2% to 0.4%, for example, SCCrM1, with the pouring temperature being in the range of about 1450° to 1600° C. When molten steel is poured, the mild steel pipe forming a holding member 16 becomes molten, and the hardened portion forming material 19 therein contacts the molten steel. Then, the tungsten cemented carbide superhard alloy particles 17, having a large specific gravity, move mainly downwardly and disperse as the surfaces thereof are slightly melted into the molten steel, while the graphite powder 18 mainly goes into solid solution and diffuses. The dispersion and diffusion are completed by the cooling and solidification of the molten steel, and a casting of the tooth 5 can be obtained. After solidification, the entirety or a part of the casting mold 10 can be forcibly cooled by conducting air-cooling, water-cooling, etc., depending on the requirements.

Figure 3:
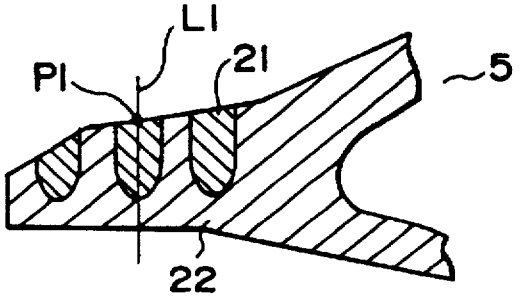
FIG. 3 is a schematic sectional view of a tooth relating to the first embodiment.

FIG. 3 illustrates a schematic section of the tooth 5 obtained in the present embodiment, wherein a plurality of hardened portions 21 are formed. There hardened portions 21 correspond to the portions of dispersion and diffusion of the superhard alloy particles 17 and the graphite powder 18 (refer to FIG. 2), and the tooth 5 is a cast part having hardened portions at desired positions. The amount of carbon on a hardened sectional part of the tooth 5 is analyzed by EPMA along the line L1 in the inward direction from the surface P1. Estimating from the analyses data, there is a large amount of carbon in the portion from the surface P1 to the inside of the hardened portion, and then the amount of carbon gradually decreases from the inside of the hardened portion toward the back so as to be equal to the amount of carbon in the base material 22. This cast part has a high-carbonate layer from the surface to the inside with the superhard alloy particles 17 being dispersed so as to form the hardened layer 21 with a high degree of hardness, and the depth of the hardening is extremely large. Accordingly, this cast part not only has wear resistance with hardened portions, but also includes toughness since the other portions are made of a base material with a relatively low degree of hardness.

Figure 4:
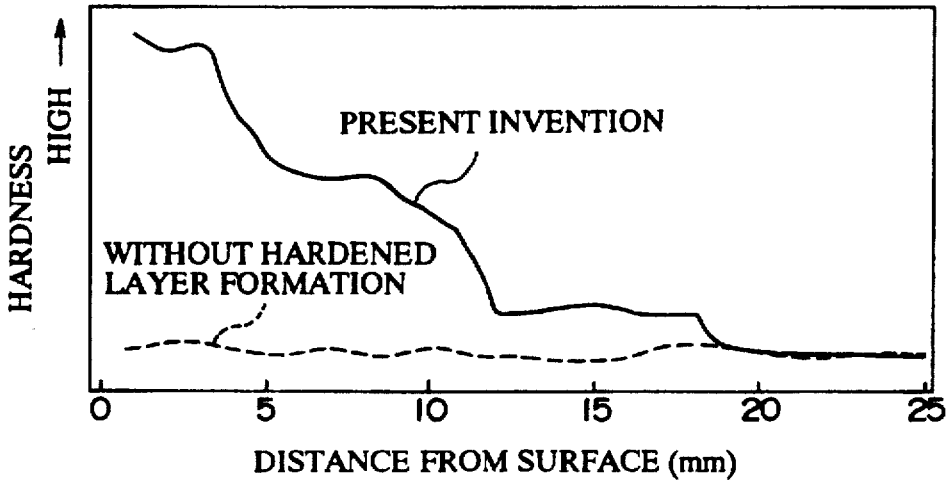
FIG. 4 is a graph showing the distribution of the degree of hardness in the section after heat treatment is applied to a tooth relating to the first embodiment.

When a tooth 5 for heavier loads is further demanded, the degree of hardness can be increased by conducting the above-described forcible cooling, and if necessary, heat treatment can be performed after solidification. For the heat treatment, a typical heat treatment such as quenching, tempering, etc., can be applied, and in this embodiment, after heating to 95° C., oil quenching is conducted, then tempering at 200° C. and air-cooling are conducted. As for the tooth 5 obtained by this method, the distribution of hardness on the section (on the same line as the line L1 in FIG. 3) measured with a Vickers hardness tester is illustrated in FIG. 4. As is clear from the drawing, the hardened depth is large, being about 18 mm. According to an observation of the sectional structure, it is estimated that the hardened portion from the surface to a depth of about 3 mm has densely concentrated superhard alloy particles, and the hardened portion at a depth of about 3 mm to about 11 mm has a dispersion of superhard alloy particles with a martensite as its base. Though the hardened portion at a further depth up to about 18 mm has decreasing amounts of carbon, the hardened portion has martensite as its base. With an extremely high average hardness (Vickers hardness) of 804 at the portion where superhard alloy particles are densely concentrated, the present cast part has toughness as well as wear resistance with long lasting quality.

Now, the second embodiment of the method for casting wear resistant parts relating to the present invention will be described with reference to the drawings. The present embodiment is applied to the tooth 5 of a cutting part of an excavating machine as an example for the applications, as in the first embodiment.

Figure 5:
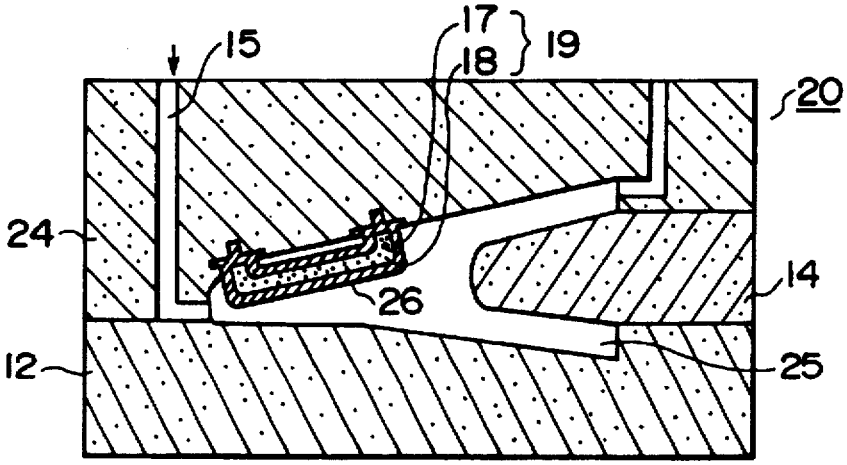
FIG. 5 is an explanatory view of the section of the casting mold relating to the second embodiment of the present invention.
Figure 6:
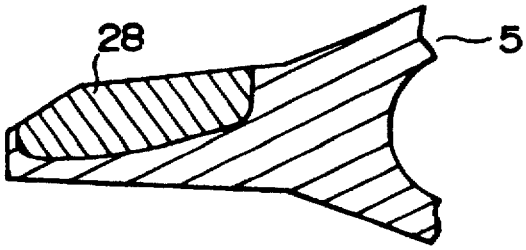
FIG. 6 is a schematic sectional view of a tooth relating to the second embodiment.

In FIG. 5, a casting mold section 24, defining a casting mold 20, includes a holding member 26, with one part of the holding member 26 projecting into a cavity 25 with another part of the holding member 26 being buried in the casting mold section 24. The cavity of the holding member 26, formed by bending a mild steel pipe into a substantially U-shaped form, is filled with the hardened portion forming material 19, and the sealed portions are secured in the casting mold section 24. These holding members 26 are provided at three points in the casting mold section 24 so as to be parallel to the longitudinal direction of the tooth 5.

Molten steel for steel casting is poured into the casting mold 20 with the above-described constitution and is cooled for solidification. The tooth 5, obtained by this method, has a hardened portion 28 formed in the position corresponding to the portions having the dispersion of the superhard alloy particles 17 and the diffusion of the graphite powder 18; and a cast part, having both wear resistance and toughness, can be obtained as in the first embodiment.

Now, the third embodiment of the method for casting wear resistant parts relating to the present invention will be described with reference to the drawings. The present embodiment is applied to a ripper point which is a type of cutting part used in construction machinery for excavation.

Figure 7:
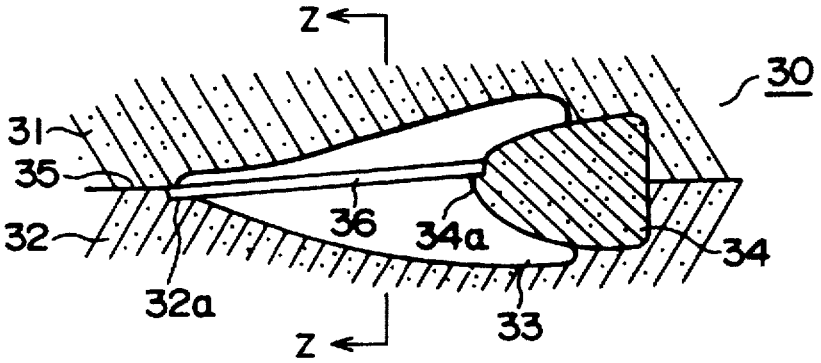
FIG. 7 is an explanatory view of a main section of the casting mold relating to the third embodiment of the present invention.

In FIG. 7, a casting mold 30 for a ripper point is defined by casting mold sections 31 and 32 and a core 34, and forms a cavity 33 for a ripper point. After a holding member 36, of a mild steel pipe has been filled with tungsten carbide particles as a hardened portion forming material (not illustrated), both ends thereof are sealed. Both of these ends are placed at a notched portion 34*a* of the core 34 and at a notched portion 32*a* of the casting mold 32, and are secured by a split surface 35 of the casting mold sections 31 and 32. These holding members 36 are provided at five points in the transverse direction (in FIG. 7, back-and-forth direction) of the ripper point.

Figure 8:
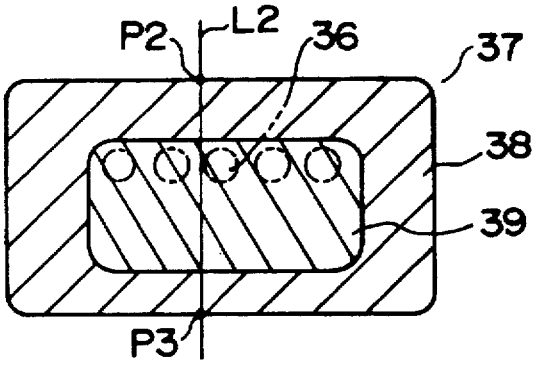
FIG. 8 is a schematic sectional view of a ripper point corresponding to a section taken along line 8—8 in FIG. 7.

Molten steel of low-alloy steel is poured into the casting mold 30 with the above-described constitution and is cooled for solidification, as in the first embodiment. A ripper point 37 obtained in this way has a hardened portion 39 formed inside and a base material 38, having the characteristics of the components of the molten steel, formed outside, as FIG. 8 illustrates. Five circles formed by a two-dot chain line in the upper portion of the hardened portion 39 show the estimated locations of the holding members 36 before the molten steel is poured.

Figure 9:
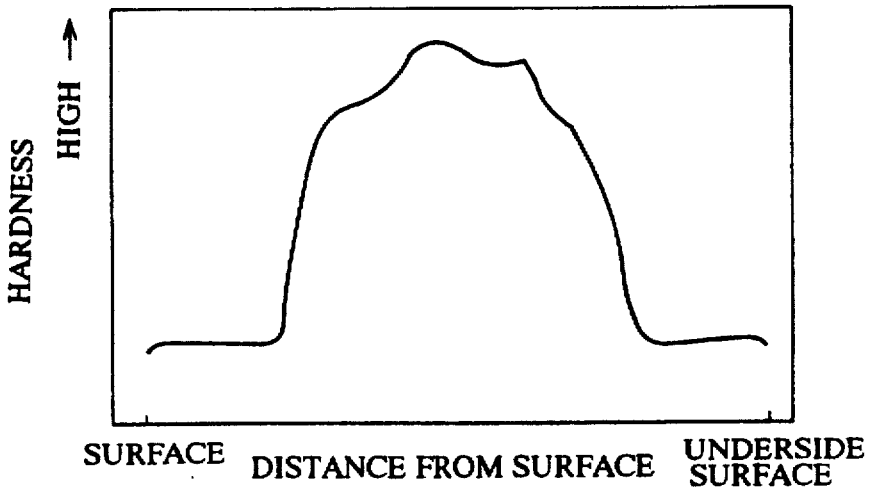
FIG. 9 is a graph showing the distribution of the degree of hardness in a section of the ripper point relating to the third embodiment.

FIG. 9 is a Vickers hardness distribution value on the line L2 on the section of the ripper point 37 illustrated in FIG. 8 from the top surface P2 to the underside surface P3. The hardened portion 39 obviously has high hardness, and the hardness level at the hardest portion reaches about 850. On the other hand, the base material 38 has the hardness of about 400. As a result of an observation of the constitution, tungsten carbide is dispersed in the hardened portion 39, and at the same time an increase in the amount of carbon, which is estimated to result from the decomposition of tungsten carbide, can be recognized. From the above, the ripper point 37, which does not lose toughness on the surface and has extremely high hardness inside, is a wear resistant part with high strength. In addition, it is needless to say that a typical heat treatment such as quenching, tempering, normalizing, or the like can be applied to a ripper point, if necessary.

Next, the fourth embodiment of the method for casting wear resistant parts relating to the present invention will be described with reference to the drawings. The present embodiment is applied to an end bit forming a cutting part for construction machinery for earth-moving, etc.

Figure 10A:
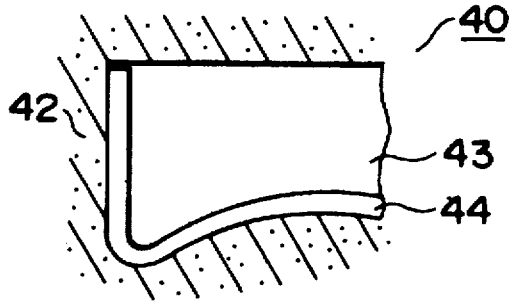

In FIG. 10A, a casting mold 40 for an end bit is defined by an upper casting mold section (not illustrated), and a lower casting mold section 42, and forms a cavity 43 for an end bit, which is in the form of a plate. The cavity of a holding member 44, of a soft steel pipe bent along the shape of the end portion of this casting mold 42, is filled with a mixture of tungsten carbide particles and molybdenum carbide particles as a hardened portion forming material (not illustrated), and the holding member 44 is placed as in FIG. 10A and secured by the upper mold section.

Figure 10B:
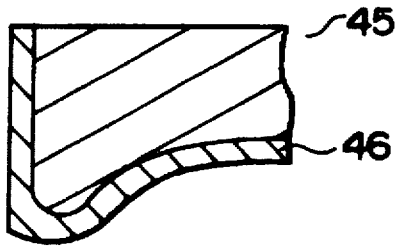

Molten steel for steel casting is poured into the casting mold 40 with the above-described constitution, and is cooled for solidification, as in the first embodiment. An end bit 45 obtained by this method, which has a hardened layer 46 formed on the end surface portion having a curved line as FIG. 10B illustrates, is a cast part having a hardened layer only in a portion where high hardness and wear resistance are desired. Further, a hardened layer can be formed on a desired curved surface by using a holding member to which a plurality of bend workings are applied.

Now, the fifth embodiment of the method for casting wear resistant parts relating to the present invention will be described with reference to the drawings. The present embodiment relates to constitutions, placement in casting molds, and sectional forms of the holding members in the above-described embodiments, as further application examples.

Figure 11:
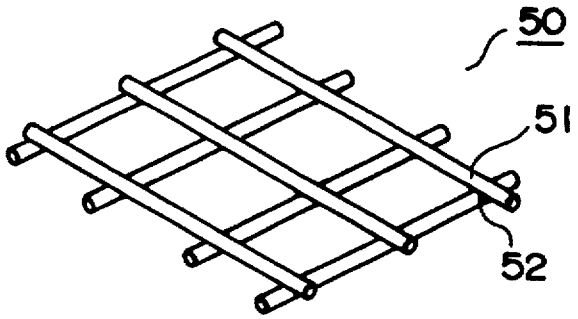
FIG. 11 is a perspective view of a net-shaped structure, consisting of a plurality of holding members, relating to the fifth embodiment of the present invention.

In FIG. 11, a net-shaped structure 50 is defined by a plurality of holding members 51 filled with a hardened portion forming material. When each holding member 51 is needed to be secured on one another, a contact portion 52 can be welded, brazed, bonded with an adhesive, etc., or wound with a fine thread such as a wire, etc. This net-shaped structure 50 is placed in a casting mold, corresponding to a desired position where a hardened layer is formed.

Figure 12:
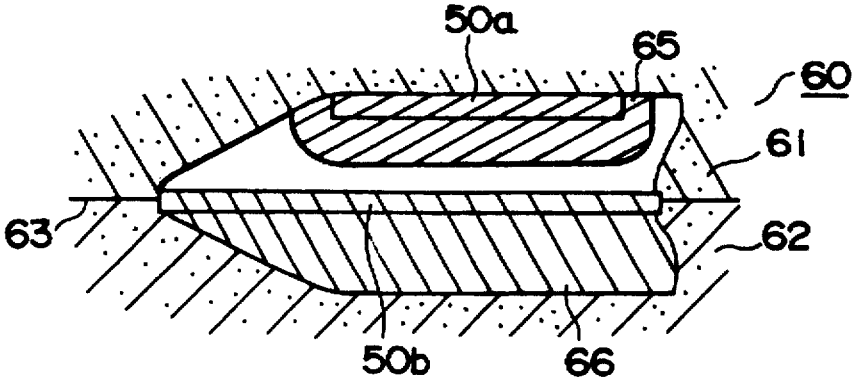
FIG. 12 is an explanatory view of a main section of the casting mold relating to the fifth embodiment.

For example, as FIG. 12 illustrates, when a hardened layer is formed on the upper side of a cast part, the net-shaped structure 50 (50*a*) is placed on the ceiling portion of a casting mold section 61 which is an upper mold section of a casting mold 60. When a hardened layer is formed on the lower side of the cast part, the net-shaped structure 50 (50*b*) is placed and secured between a casting surface 63 of the casting mold sections 61 and 62. The net-shaped structure 50 can be secured in a portion being formed, such as notches in the casting mold sections 61 and 62, etc., can be secured by a member such as an adhesive, etc., or can be secured by casting sand when a model is made. By pouring specified molten steel into the casting mold 60 in which this net-shaped structure 50 (50*a* or 50*b*) is placed, a hardened layer 65 or 66 can be obtained. These hardened layers 65 and 66 can be formed in a wide range, and have wear resistance with long lasting quality. This net-shaped structure 50 can be placed in layers, and can be formed into a desired shape such as a basket shape, etc.

The method for casting wear resistant parts relating to the present invention is described in detail above; however, the present invention is not limited to the above-described embodiments. For example, as for the holding member filled with a hardened portion forming material, a holding member with a circular section is described, but the shape of the section can be oval, polygonal, star-shaped, cylindrical, plate-shaped, in the shape of a curved surface, etc., and may be selected according to the requirements. As for the hardened portion forming material, graphite powder, and/or metallic powder such as nickel, copper, cobalt, etc., can be added other than the sole use of superhard particles. As for these superhard particles, one or more carbides selected from titanium carbide, boron carbide, chromium carbide, vanadium carbide, silicon carbide, and molybdenum carbide can be used other than tungsten carbide, or superhard particles containing various kinds of alloy particles of the above-described carbides are suitable. In addition, the wear resistant parts of the present invention are applicable to parts requiring wear resistance and toughness, and can be used for the cutting parts of various excavating machines, gears, the connecting rods of internal-combustion engines, etc.

INDUSTRIAL AVAILABILITY

The present invention, whereby not only a hardened portion is partially formed in a desired position, but also a base material portion having characteristics of the molten steel components is formed, is useful as a method for casting wear resistant parts including both wear resistance and toughness.

I claim:

1. A method for casting a wear resistant part which includes at least one superhard portion, said method comprising the steps of:

providing at least one holding member which can be melted by molten steel, each holding member having a cavity;

placing in the cavity of each of said at least one holding member a hardened portion forming material comprising superhard particles and graphite powder;

positioning said at least one holding member, containing the hardened portion forming material, in a casting mold;

pouring molten steel into the casting mold, containing the thus positioned at least one holding member, to cause the thus positioned at least one holding member to be melted into the thus poured molten steel and said superhard particles to move mainly downwardly and disperse within the thus poured molten steel while the graphite powder mainly goes into solid solution and diffuses; and solidifying the thus poured molten steel into which the at least one holding member has melted, the superhard particles have dispersed, and the graphite powder has diffused.

2. A method in accordance with claim 1, wherein said step of placing a hardened portion forming material in the cavity of each of the at least one holding member comprises filling the cavity of each holding member with said hardened portion forming material.

3. A method in accordance with claim 2, wherein each holding member comprises a pipe.

4. A method in accordance with claim 3, wherein each pipe is formed of mild steel.

5. A method in accordance with claim 4, wherein ends of each pipe are sealed after the hardened portion forming material is placed in the cavity of the pipe and prior to the positioning of the pipe in the casting mold.

6. A method in accordance with claim 5, wherein said superhard particles comprise tungsten cemented carbide superhard alloy particles.

7. A method in accordance with claim 6, wherein said molten steel comprises a low-carbon steel having a carbon content in the range of 0.2% to 0.4%, and wherein said step of pouring molten steel comprises pouring molten steel having a temperature in the range of about 1450° C. to about 1600° C.

8. A method in accordance with claim 1, wherein said hardened portion forming material comprises about 60 weight percent superhard particles and about 40 weight percent graphite powder.

9. A method in accordance with claim 1, wherein said superhard particles are selected from the group consisting of tungsten carbide, titanium carbide, boron carbide, chromium carbide, vanadium carbide, silicon carbide, molybdenum carbide, and mixtures of any two or more thereof.

10. A method in accordance with claim 1, wherein said hardened portion forming material comprising superhard particles, graphite powder, and metallic particles.

11. A method in accordance with claim 10, wherein said metallic particles are particles selected from the group consisting of nickel, copper, and cobalt.

12. A method in accordance with claim 1, wherein each holding member comprises a pipe.

13. A method in accordance with claim 12, wherein each pipe is bent to conform to a surface of said casting mold.

14. A method in accordance with claim 12, wherein each pipe is formed of mild steel.

15. A method in accordance with claim 12, wherein ends of each pipe are sealed after the hardened portion forming material is placed in the cavity of the pipe and prior to the positioning of the pipe in the casting mold.

16. A method in accordance with claim 1, wherein the at least one holding member comprises a plurality of holding members arranged to form a net structure.

17. A method in accordance with claim 1, wherein said superhard particles comprise tungsten cemented carbide superhard alloy particles.

18. A method in accordance with claim 1, wherein said molten steel comprises a low-carbon steel having a carbon content in the range of 0.2% to 0.4%, and wherein said step of pouring molten steel comprises pouring molten steel having a temperature in the range of about 1450° C. to about 1600° C.

19. A method in accordance with claim 1, wherein said step of positioning the at least one holding member comprises positioning each of said at least one holding member so that one portion of the holding member extends into a mold cavity in said casting mold and another portion of the holding member is held by said casting mold.

* * * * *